US009532619B1

(12) United States Patent
Warra et al.

(10) Patent No.: US 9,532,619 B1
(45) Date of Patent: Jan. 3, 2017

(54) HAND-HELD FACEMASKS

(71) Applicants: Jerry S. Warra, Livonia, MI (US); Linda E. Warra, Livonia, MI (US)

(72) Inventors: Jerry S. Warra, Livonia, MI (US); Linda E. Warra, Livonia, MI (US)

( * ) Notice: Subject to any disclaimer, the term of this patent is extended or adjusted under 35 U.S.C. 154(b) by 82 days.

(21) Appl. No.: 14/251,614

(22) Filed: Apr. 13, 2014

Related U.S. Application Data

(60) Provisional application No. 61/811,716, filed on Apr. 13, 2013.

(51) Int. Cl.
*A42B 1/00* (2006.01)

(52) U.S. Cl.
CPC ..... *A42B 1/004* (2013.01)

(58) Field of Classification Search
CPC . A41D 13/11; A41D 13/1184; A41D 13/1161; A41G 7/00; A41G 5/0093; A42B 3/20; A42B 1/004; A42B 1/006; A42B 1/12; A45D 44/002; A45D 44/12
USPC .... 2/173, 181, 182.1, 200.2, 206, 9; 11/173, 11/181, 182.1, 200.2, 206, 9
See application file for complete search history.

(56) References Cited

U.S. PATENT DOCUMENTS 3,555,559 A * 1/1971 Hundhausen ..... A45D 44/12 2/11
4,223,407 A * 9/1980 Zappala ..... 2/174
4,856,535 A * 8/1989 Forbes ..... 128/857
5,014,353 A * 5/1991 Brown et al. ..... 2/11
D321,957 S * 11/1991 Brown ..... D29/110
5,146,629 A * 9/1992 Barnes ..... 2/174
5,797,141 A * 8/1998 Morlett ..... 2/9
2008/0066209 A1* 3/2008 Kayerod ..... 2/15
2008/0168594 A1* 7/2008 Bratton ..... 2/174
2009/0165188 A1* 7/2009 Nies ..... 2/174
2010/0138979 A1* 6/2010 Thompson ..... 2/174
2010/0154100 A1* 6/2010 Shao ..... 2/174
2012/0246789 A1* 10/2012 Hunter ..... 2/9

FOREIGN PATENT DOCUMENTS

CN 202761534 U * 3/2013 ..... A61F 9/04

OTHER PUBLICATIONS http://www.drieyes.com.au/.

* cited by examiner

*Primary Examiner* — Khaled Annis
(74) *Attorney, Agent, or Firm* — George L. Boller

(57) ABSTRACT

Designs and constructions for facemasks which, when properly used, can enable a small child's head hair to be washed by a parent without interference by the child while preventing liquid being applied to the head hair from washing across eyes, nose and mouth. The facemask has handgrips at either side which are grasped by the hands of the child while the child presses a seal against his/her forehead. The facial designs of the masks present artistic renderings of animals' faces, cartoon characters, etc.

15 Claims, 10 Drawing Sheets

HAND-HELD FACEMASKS

FIELD

The present disclosure relates to facemasks.

BACKGROUND

It is known to cover at least a portion of a person's face when certain substances are being applied to a person's scalp, such as when the person's hair and/or scalp is/are being treated and/or washed and rinsed.

A purpose of doing so is to protect a person's eyes, nose, and/or mouth from liquid or substances which may be carried by a liquid.

SUMMARY OF THE DISCLOSURE

Some persons, small children for example, may be unable to wash their own hair, and consequently that task must be performed by another person. A responsible adult whose hair is being washed is unlikely to interfere with washing of his/her own hair by another person. That is not necessarily true of a young child.

The inventors have created designs and constructions for facemasks which, when properly used, can enable a small child's hair to be washed by a parent or other older person without interference by the child while preventing liquid being applied to the scalp and hair from washing across eyes, nose and mouth. For purposes of description in the present disclosure, a parent can be considered a second person and a child a first person.

These designs and constructions are intended to be grasped by both hands of the first person to whose scalp and hair liquid is being applied by the second person.

One general aspect of the disclosure relates to a facemask comprising: a mask body shaped for anterior placement over at least a person's forehead, eyes, cheeks, nose and mouth; the mask body having a superior margin which leaves a person's scalp uncovered so as to allow liquid to be applied to the scalp; the mask body having right and left margins disposed laterally beyond the eyes, cheeks and mouth and extending inferiorly from the superior margin to an inferior margin of the mask body; a seal disposed on a posterior surface of the superior margin and extending between the right and left margins for sealing the mask body to the forehead along the superior margin from a first location outward of one eye to a second location outward of the other eye to prevent intrusion of liquid between the mask body and the forehead; a right handgrip which joins with the right margin for grasping by a person's right hand; and a left handgrip which joins with the left margin for grasping by a person's left hand.

In one embodiment, the right handgrip is defined by a right through-slot in the mask body through which fingers of a person's right hand can extend, and the left handgrip is defined by a left through-slot in the mask body through which fingers of a person's left hand can extend.

Another general aspect of the disclosure relates to a method of enabling a second person to wash a first person's scalp and hair without manual interference by the first person.

The method comprises: placing a mask body anteriorly over at least a forehead, eyes, cheeks, nose and mouth of the first person to dispose a superior margin of the mask body which extends between right and left lateral margins of the mask body, which are laterally beyond the eyes, cheeks and mouth and which extend inferiorly from the superior margin to an inferior margin of the body, in a position which leaves the first person's scalp uncovered so as to allow liquid to be applied to the first person's scalp while causing a seal on a posterior surface of the superior margin to seal continuously to the first person's forehead from a first location outward of one eye of the first person to a second location outward of the other eye of the first person to prevent intrusion of liquid between the mask body and the first person's forehead; and after the mask has been so placed, using the first person's hands to hold the mask body in place by the first person's right hand grasping a right handgrip which joins with the right lateral margin and by the first person's left hand grasping a left handgrip which joins with the left lateral margin.

The foregoing summary is accompanied by further detail of the disclosure presented in the Detailed Description below with reference to the following drawings which are part of the disclosure.

DETAILED DESCRIPTION

Figure 1:
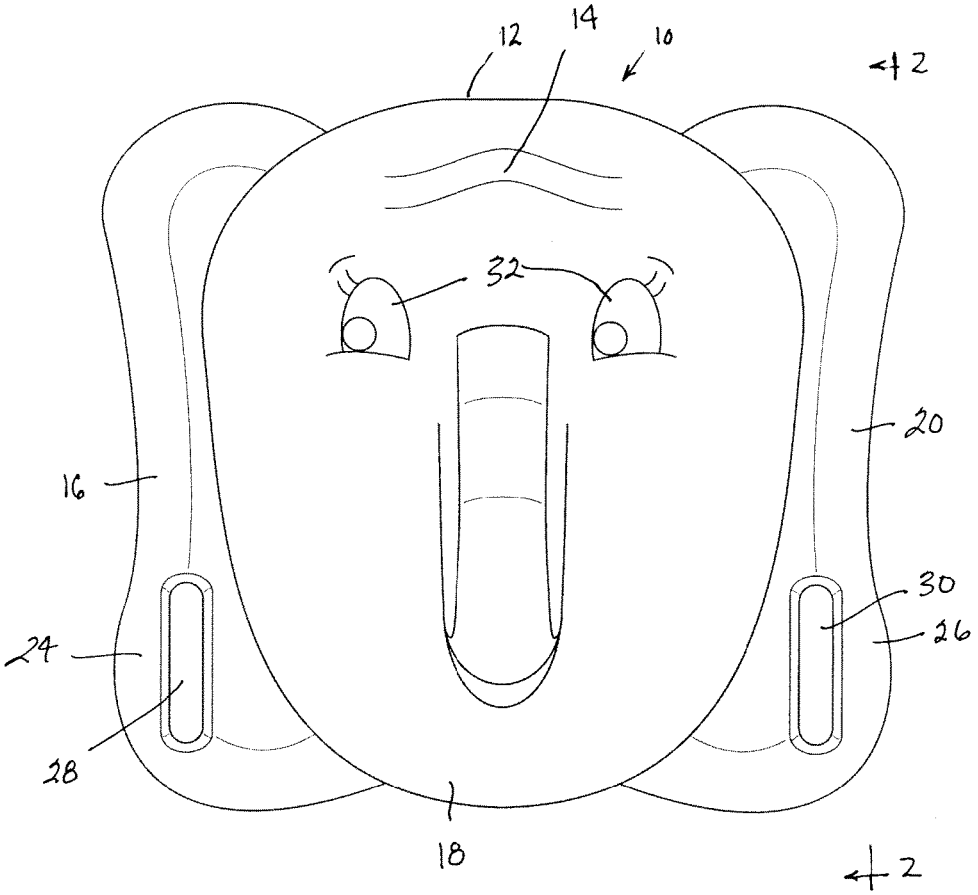
FIG. 1 is a front view of one embodiment of facemask.
Figure 2:
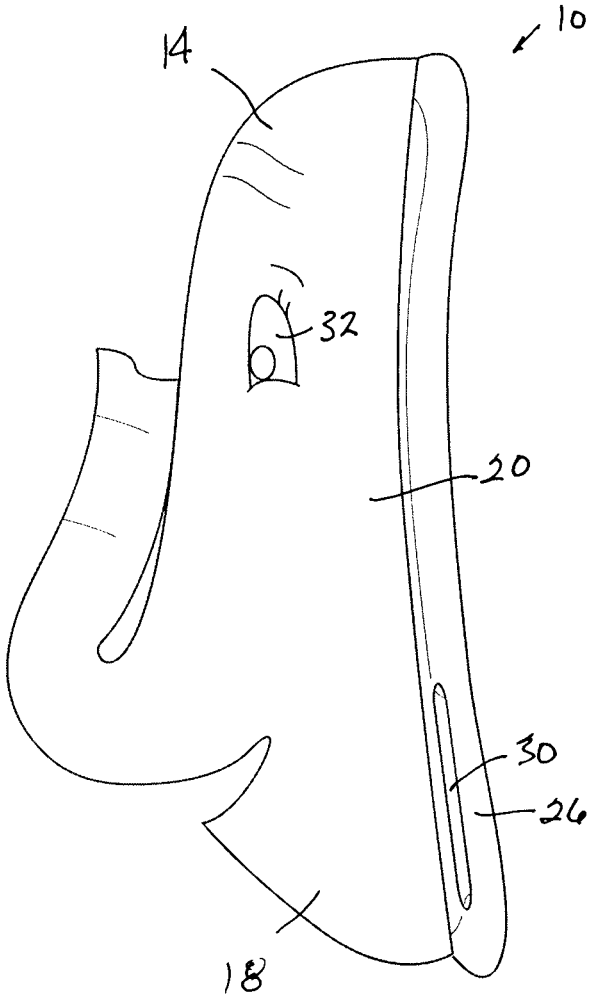
FIG. 2 is a left side view of FIG. 1 in the direction of arrows 2-2 in FIG. 1.
Figure 3:
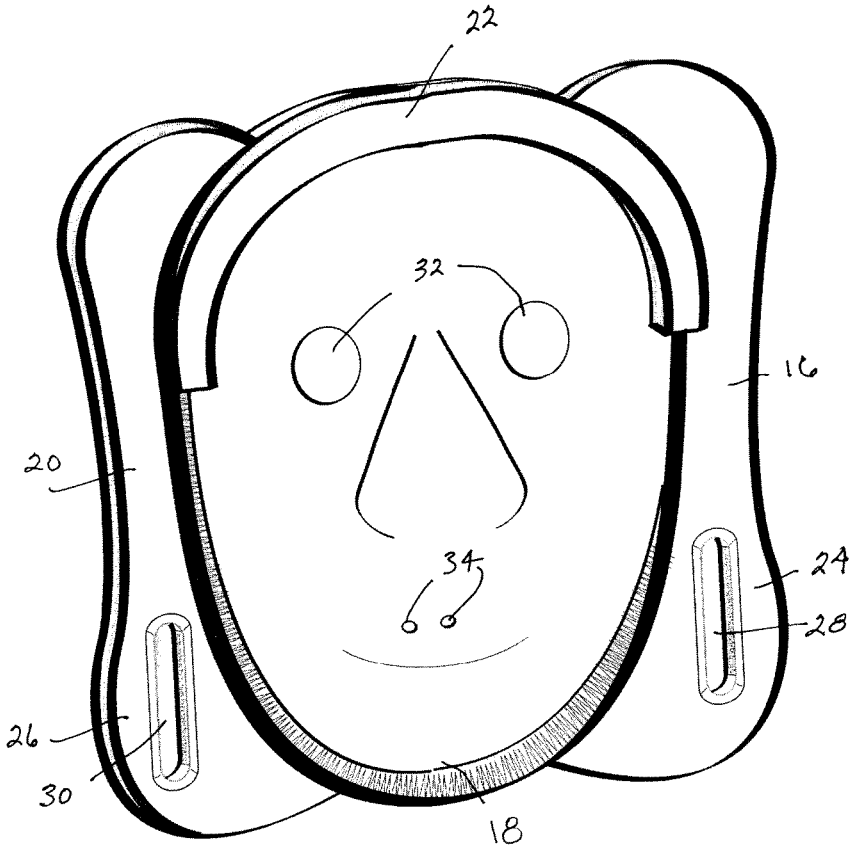
FIG. 3 is perspective view of FIG. 1 from the rear.

FIGS. 1-4 show a facemask 10 having a mask body 12 shaped for anterior placement over at least a person's forehead, eyes, cheeks, nose and mouth. The mask body which is illustrated in FIGS. 1-4 covers the forehead, eyes, cheeks, nose, and mouth.

Mask body 12 has a superior margin 14 which leaves a person's scalp uncovered so as to allow liquid to be applied to the scalp and its hair.

Mask body 12 also has a right margin 16 disposed laterally of the medial plane beyond the eyes, cheeks and mouth and extending inferiorly from superior margin 14 to an inferior margin 18 of mask body 12, and a left margin 20 disposed laterally of the medial plane beyond the eyes, cheeks and mouth and extending inferiorly from superior margin 14 to inferior margin 18.

A seal 22 is disposed on a posterior surface of superior margin 14 and extends between right margin 16 and left margin 20 for sealing mask body 12 to a person's forehead along superior margin 14 to prevent intrusion of liquid between mask body 12 and the person's forehead.

A right handgrip 24 joins with right margin 16 and is large enough for grasping by a person curling fingers of his/her right hand around the right handgrip 24. A left handgrip 26 joins with left margin 20 and is large enough for grasping by a person curling fingers of his/her left hand around the left handgrip.

Right handgrip 24 is defined in part by a right through-slot 28 in mask body 12 through which fingers of a person's right hand can extend. Left handgrip 26 is defined in part by a left through-slot 30 in mask body 12 through which fingers of a person's left hand can extend.

The embodiment shown presents a facial appearance corresponding to that of an artistic rendering of an animal character, an elephant in this instance. Such embodiments are intended to encourage use of the masks by young children.

The eyes 32 are transparent material which allows the user to see through the mask and the mask body has air holes 34 which allow the user to breathe freely without drawing in liquid.

Figure 4:
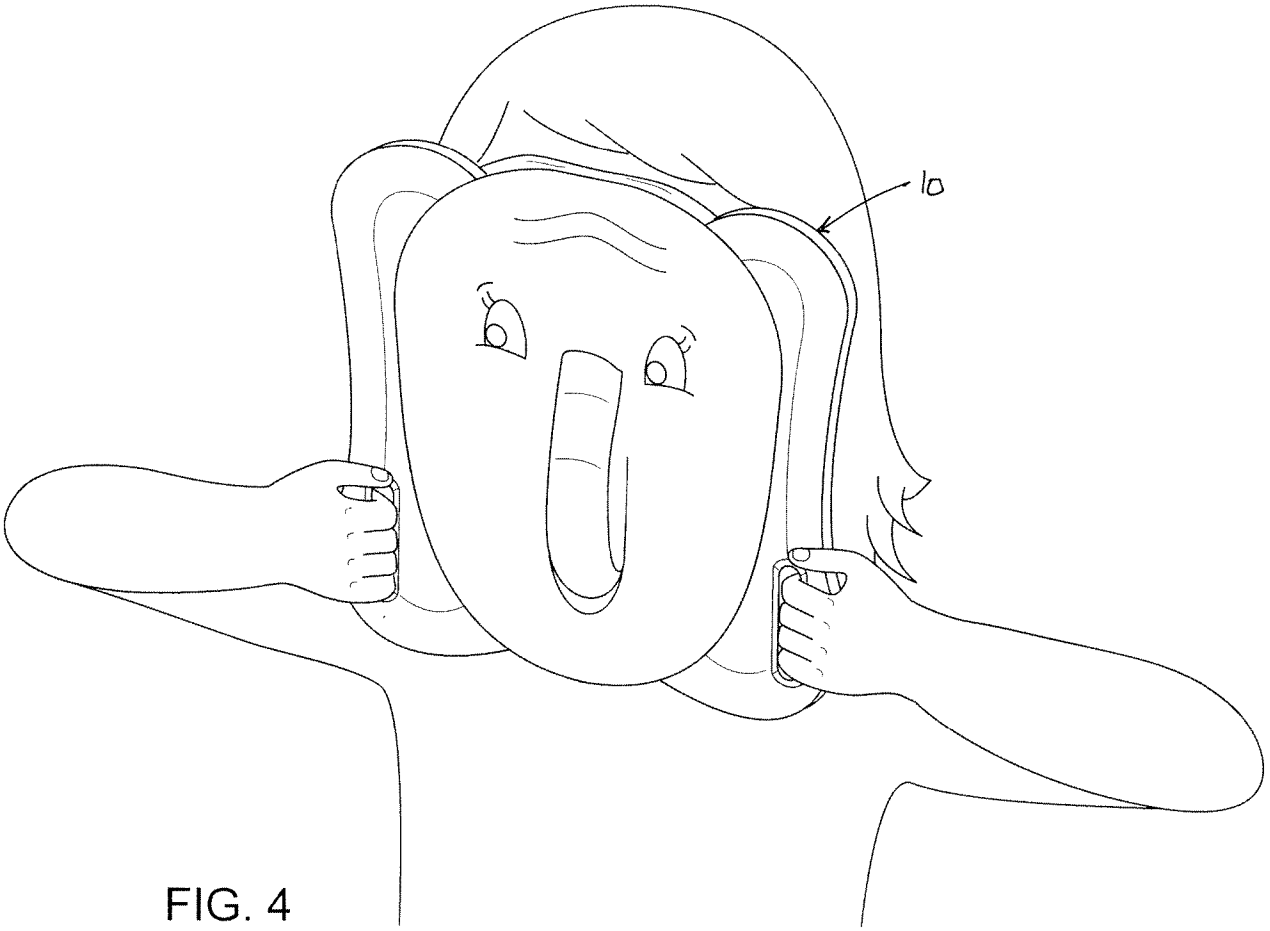
FIG. 4 is a perspective view illustrating use of the facemask of FIG. 1.

FIG. 4 shows mask 10 in use over a child's face. The fingers of the child's hands grasp the handgrips 24, 26 and hold mask 10 over his/her face while pressing seal 22 against his/her forehead. The thumbs are shown against the sides, but alternately can go behind them to aid in more forceful gripping of the handgrips.

Other designs and constructions which are contemplated but not necessarily illustrated in the Figures include: Dolphin and Turtle where the mask shows the front of the character's face and a fin extends from the mask body at each of the right and left sides allowing the fins themselves to be the hand grips. Alternately, through-slots can be added to create the handgrips.

Still others which have through-slots forming the handgrips include: Zebra, Horse, Gorilla, Monkey, Grizzly Bear, Giraffe, Panda Bear, Polar Bear, Tiger, Lion, Raccoon, Dog and Cat. These masks show the animal's face with the through-slots on either side.

For an Octopus, the mask is constructed in a way to allow the 8 legs of the octopus to be split 4 on the right side and 4 on the left side of the mask for use as the handgrips.

For a Camel, the mask shows the face with the animal's ears protruding on the right and left sides to be used as the handgrips.

FIGS. 5-7 and 9 show another facemask having a mask body 48 comprising bottom mask part 50, a top mask part 52, and a seal 54. Bottom mask part 50 has a top edge 56 which fits congruently to a bottom edge 58 of top mask part 52 so that the anterior surface of the two fitted-together parts 50, 52 forms the complete mask body 48 having a face of an animal character. A generally concave posterior surface of the parts 50, 52 fits over at least a person's forehead, eyes, cheeks, nose and mouth. The facemask which is illustrated covers the forehead, eyes, cheeks, nose, mouth, and chin.

Top mask part 52 forms a superior margin which leaves a person's scalp uncovered so as to allow liquid to be applied to the scalp and its hair. Collectively, bottom mask part 50 and top mask part 52 provide the facemask with a right margin disposed laterally of the medial plane beyond the eyes, cheeks, mouth, and chin and extending inferiorly from the superior margin to an inferior margin which is contained entirely in bottom mask part 50. Collectively, parts 50 and 52 provide the facemask with a left margin disposed laterally of the medial plane beyond the eyes, cheeks, mouth, and chin and extending inferiorly from the superior margin to the inferior margin.

Seal 54 runs along top edge 56 and bottom edge 58 between a location (reference numeral 62) below and laterally outward of the facemask's right eye and a location (reference numeral 64) below and laterally outward of the mask's left eye. With bottom and top parts 50, 52 fit together, seal 54 is not seen when looking toward the front of the facemask as in FIG. 5.

Figure 9:
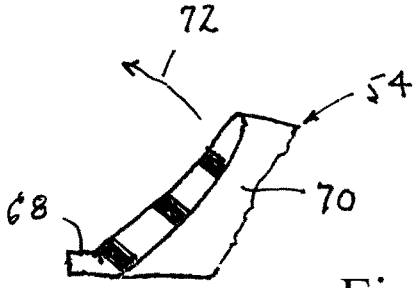
FIG. 9 is a fragmentary cross section view showing shape of a seal at its midpoint above the nose.
Figure 10:
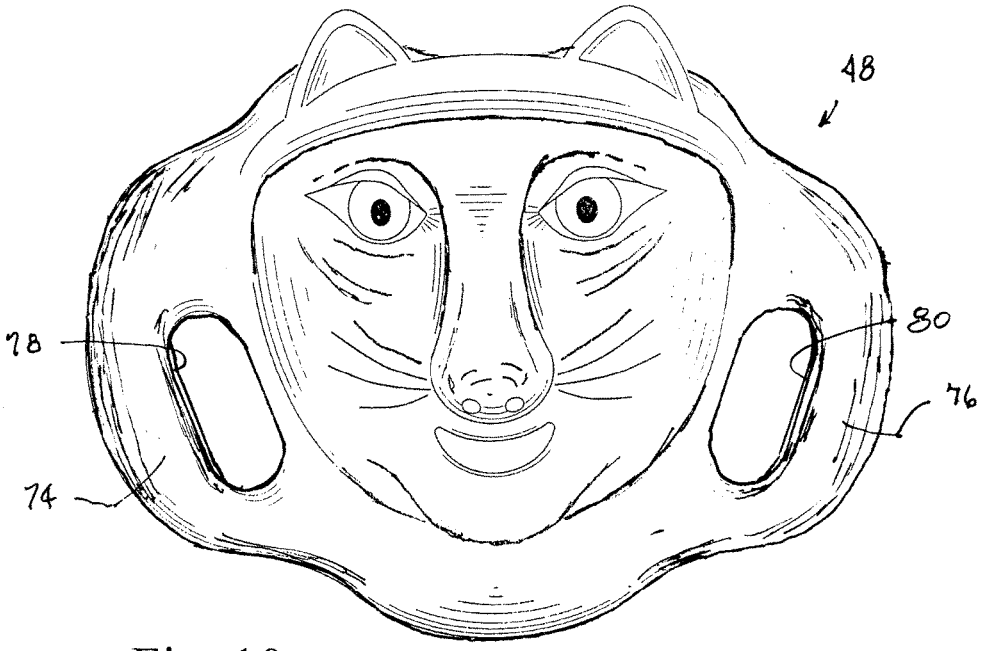
FIG. 10 is a front view of still another embodiment.
Figure 11:
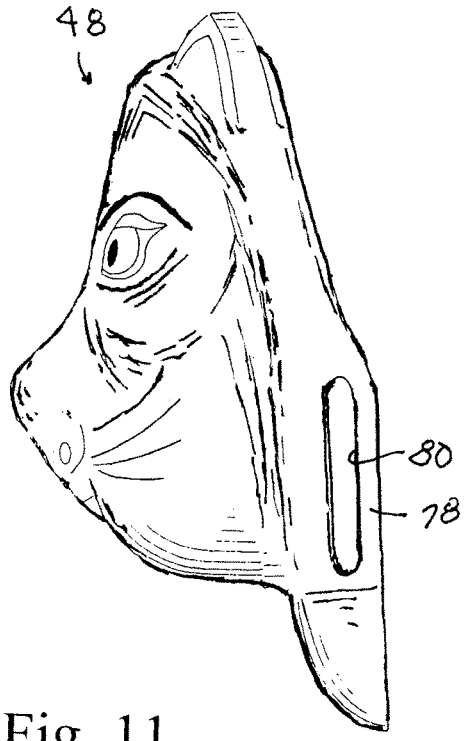
FIG. 11 is a side view of the left side of the mask shown in FIG. 10.
Figure 12:
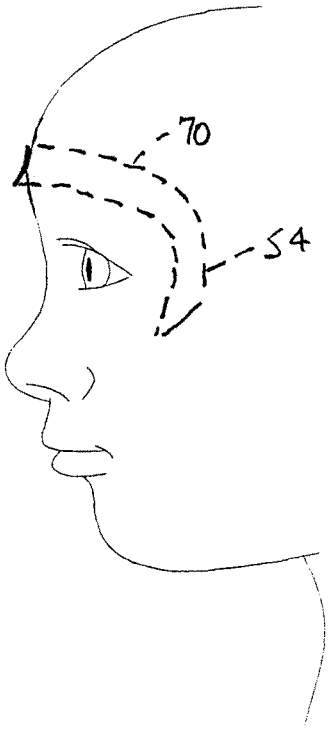
FIG. 12 is a left side view of a child's face.

FIG. 9 shows the cross section shape of seal 54 at its midpoint above the nose. From the midpoint the seal runs along generally horizontal, but slightly curved portions 66 of edges 56, 58 before turning downward and slightly outward toward lengthwise ends of the seal at 62 and 64. Laterally outward beyond ends of seal 54, edges 56, 58 are essentially horizontal as they curve rearward and outward in both right and left margins.

The portion of seal 54 running generally horizontal has a base 68 which is trapped between edges 56, 58. In addition to being mechanically trapped, it may be adhered to one or both mask parts 50, 52. A sealing lip 70 extends upward and rearward from base 68 beyond top edge 56. Sealing lip 70 may have an upwardly concave shape as shown. Seal 54 is molded to its shape by molding material which when cured is elastomeric, such as silicone rubber, which allows sealing lip 70 to flex in the sense indicated by arrow 72 in FIG. 9.

Bottom and top mask parts 50, 52 may be held fast together in any of various ways, such as by incorporating features which allow them to be snapped together without using fasteners, features which will accept fasteners, and/or features which allow them to be adhesively joined or bonded together. Such features are located so as to not interfere with the sealing of the facemask to a person's face as described herein.

A right handgrip 74 in bottom part 50 is large enough for grasping by a person curling fingers of his/her right hand around it. A left handgrip 76 is large enough for grasping by a person curling fingers of his/her left hand around it.

Each handgrip is defined in part by a respective through-slot 78, 80 through which fingers of a person's respective hand can extend.

Figure 7:
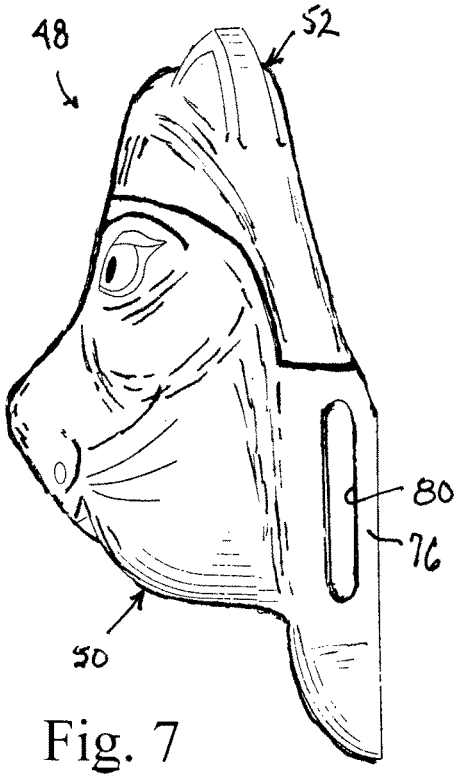
FIG. 7 is a side view of the left side of FIG. 5.
Figure 8:
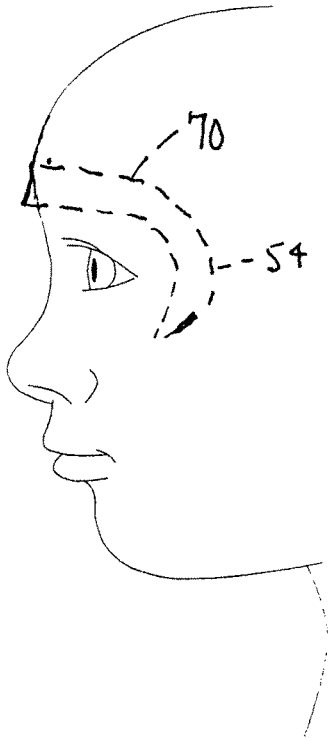
FIG. 8 is a left side view of a child's face.

When used, the facemask is grasped with both hands by a person to whose hair a liquid is to be applied and is placed over his/her face with corresponding parts of the mask face in approximate registration with the person's eyes, nose, cheeks, mouth, and chin as suggested by FIGS. 7 and 8. Sealing lip 70 is pressed against the forehead by the person's arms forcing the facemask in the posterior direction, flexing a portion of the surface area of the sealing lip into contact with the forehead to seal continuously from a location outward of one eye to a location outward of the other eye. Where seal 54 begins to turn downward, sealing lip 70 ends by merging into sides of seal 54 which are thick enough laterally to resiliently compress as they come into contact with the person's temples as the facemask is being forced in the posterior direction, and which extend downward below the level of the person's eyes. In this way the facemask is sealed to the forehead along a surface area extending from a location laterally outward of one eye to a location laterally outward of the other eye and then downward along the temples to a point below the eyes as suggested in FIG. 8 where sealing lip 70 is shown in phantom.

Alternately, a second person who will be washing the scalp of a first person can place the facemask in proper position and then instruct the first person to grasp the handgrips and hold the facemask in place.

When the scalp is being washed, the seal directs liquid running down the forehead laterally away from the eyes and then downward posterior to the eyes to a level below the eyes. By requiring the person whose scalp is being washed to hold the facemask in place to maintain the sealing contact, that person's hands do not interfere with the scalp washing process.

Figure 5:
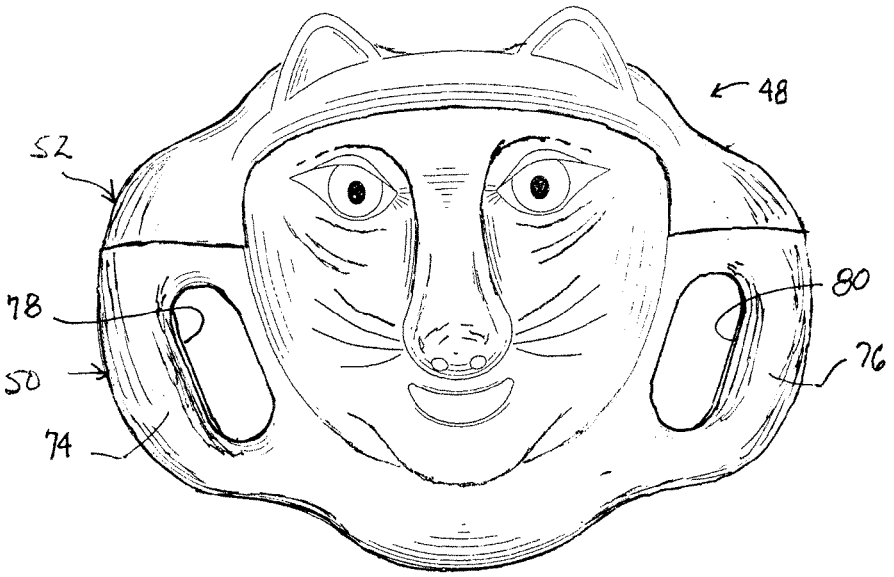
FIG. 5 is a front view of still another embodiment.
Figure 6:
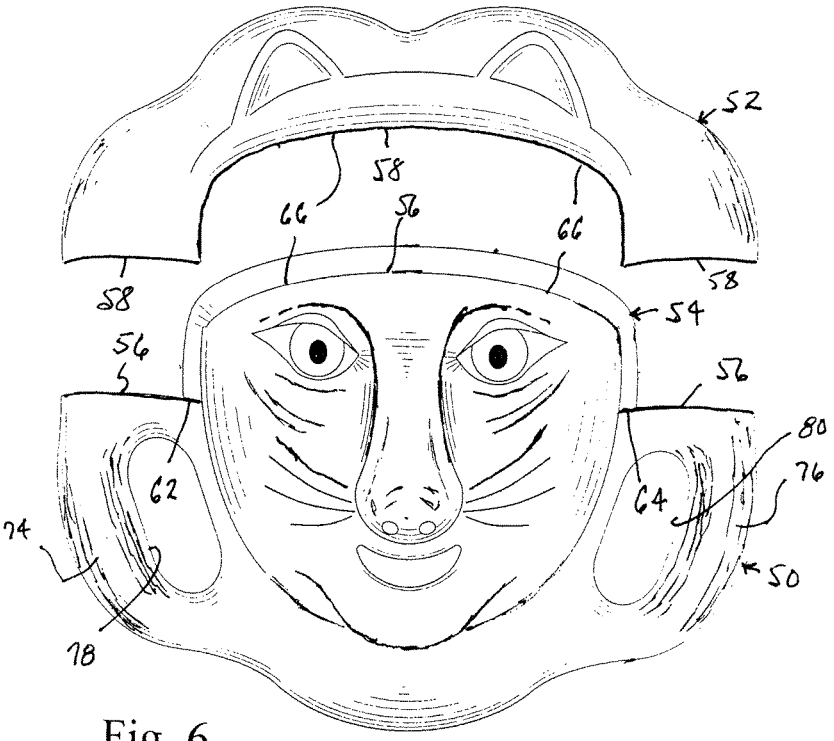
FIG. 6 is an exploded view of FIG. 5.
Figure 15:
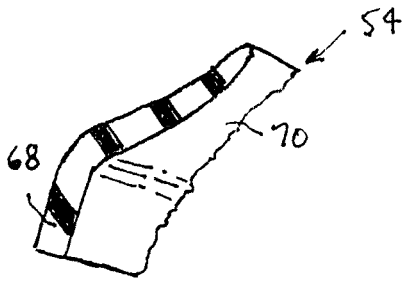
FIG. 15 is an enlarged cross section view of the seal of FIGS. 13 and 14 taken in the direction of arrows 15-15 in FIG. 13.
Figure 14:
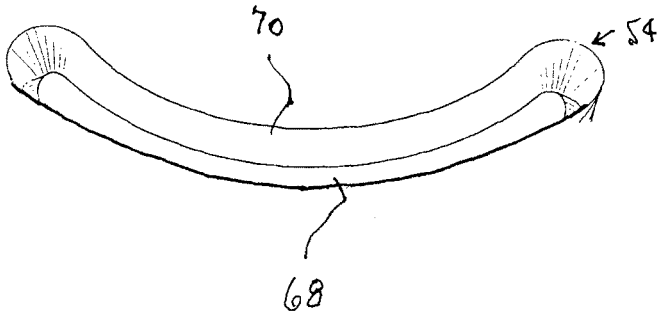
FIG. 14 a fragmentary cross section view in the direction of arrows 14-14 in FIG. 13.

FIGS. 10, 11, and 13-15 show a facemask like the one in FIGS. 5-7 but having a one-piece mask body which in all material respects is identical to mask body 48. FIG. 15 shows the cross section shape of seal 54 at its midpoint above the nose. Seal 54 of FIG. 15 places its sealing lip 70 in the same position as described in FIGS. 5-7 but has a different shaped base 68.

Base 68 is assembled to the posterior surface of the margin of top edge 56 of bottom mask part 50 of mask body 48 in FIG. 6 in any suitably appropriate way such as by adhesive and/or fasteners. Sealing lip 70 extends upward and rearward from base 68 to place sealing lip 70 on the person's face in the same location as in FIG. 8.

Figure 16:
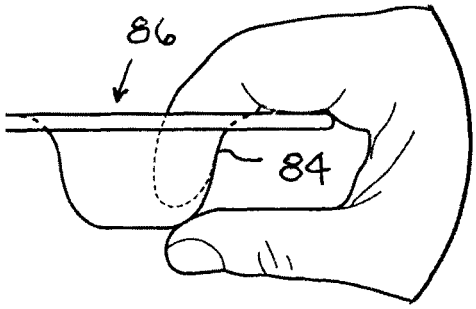
FIGS. 16 and 17 show a modified form of handgrip.
Figure 17:
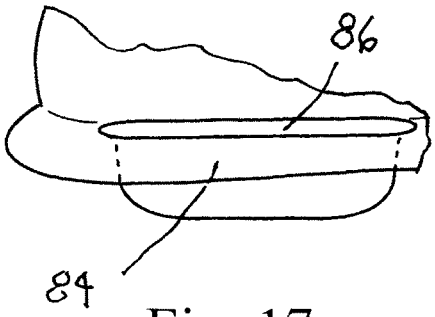
Figure 13:
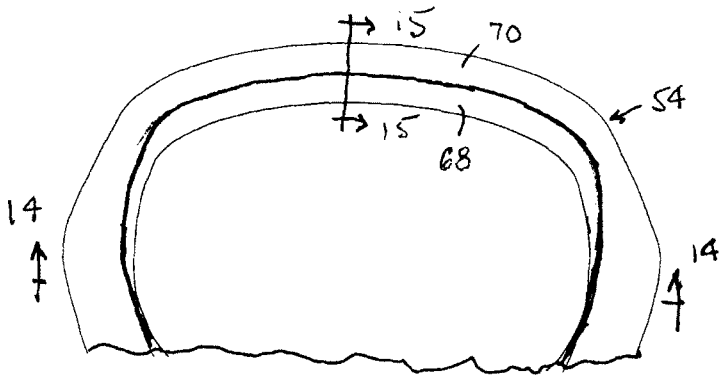
FIG. 13 is a fragmentary rear view of a seal.

FIGS. 16 and 17 show a modified form of handgrip 84 which is formed by a depression 86 in the mask body rather than a through-slot as in the previous Figures. The mask body of all masks can itself be fabricated by molding of a suitable plastic material which when cured will be fairly rigid, but may have a slight degree of flexibility. Plastic is non-absorbent to liquids such as shampoo and water.

The embodiments of the various Figs. and accompanying descriptions, especially the embodiment of FIGS. 1-4, disclose that the right lateral margin comprises a right wall which extends to the right of the concave interior of the mask body which fits over the first person's face and the left lateral margin comprises a left wall which extends to the left of the concave interior of the mask body which fits over the first person's face. In FIGS. 1-4 those walls are the elephant's ears which are spaced laterally outward of the concave interior of the mask body. FIG. 4 shows that the concave interior of the mask body has a concave posterior surface. It also shows that the right wall which contains the right handgrip has a posterior surface extending from the posterior surface of the concave interior of the mask body and that the left wall which contains the left handgrip has a posterior surface extending from the posterior surface of the concave interior of the mask body. The angle at which the posterior surface of each wall extends from the posterior surface of the concave interior of the mask body is greater than a straight angle, and is in fact significantly greater.

What is claimed is:

1. A method of enabling a first person's scalp to be washed by a second person without manual interference by the first person, the method comprising: placing a concave posterior surface of a mask body anteriorly over at least a forehead, eyes, cheeks, nose and mouth of the first person to dispose a superior margin of the mask body which extends between right and left lateral margins of the mask body, which are laterally beyond the eyes, cheeks and mouth and which extend inferiorly from the superior margin to an inferior margin of the body, in a position which leaves the first person's scalp uncovered, while also disposing a right handgrip in a wall of the right lateral margin which extends laterally outward to the right from the concave posterior surface and a left handgrip in a wall of the left lateral margin which extends laterally outward to the left from the concave posterior surface and providing a seal on a posterior surface of the superior margin to seal continuously to the first person's forehead from a first location outward of one eye of the first person to a second location outward of the other eye of the first person to prevent intrusion of liquid between the mask body and the first person's forehead; and after the mask body has been so placed, using the first person's hands to hold the mask body in place by the first person's right hand grasping the right handgrip and by the first person's left hand grasping the left handgrip.

2. A method as set forth in claim 1 including causing the seal to resiliently compress into sealing contact with the first person's temples as the seal also seals against the first person's forehead.

3. A method as set forth in claim 2 including causing the seal to seal from both the first location and the second location along the first person's temples to ends of the seal at a level below the first person's eyes.

4. A method as set forth in claim 3 in which the first person holds the mask body in place by grasping with fingers of his/her right hand curling around the right handgrip and with fingers of his/her left hand curling around the left handgrip.

5. A method as set forth in claim 4 in which the right handgrip is defined in part by a right through-slot in the mask body through which fingers of a person's right hand can extend, the left handgrip is defined in part by a left through-slot in the mask body through which fingers of a person's left hand can extend, and in which the first person holds the mask body in place by passing fingers of his/her right hand through the right through-slot to grasp the right handgrip and by passing fingers of his/her left hand through the left through-slot to grasp the left handgrip.

6. A method as set forth in claim 2 in which causing the seal to resiliently compress into sealing contact with the first person's temples as the seal also seals against the first person's forehead comprises causing thickness of the seal to resiliently compress laterally into sealing contact with the first person's temples as the seal also seals against the first person's forehead.

7. A method as set forth in claim 1 in which using the first person's hands to hold the mask body in place by the first person's right hand grasping the right handgrip and by the first person's left hand grasping the left handgrip comprises grasping the right handgrip at a location below the eyes of the first person and grasping the left handgrip at a location below the eyes of the first person.

8. A method as set forth in claim 1 further comprising applying a liquid to the first person's scalp.

9. A method of enabling a first person's scalp to be washed by a second person without manual interference by the first person, the method comprising:

placing a concave posterior surface of a mask body anteriorly over at least a forehead, eyes, cheeks, nose and mouth of the first person to dispose a superior margin of the mask body which extends between right and left lateral margins of the mask body, which are laterally beyond the eyes, cheeks and mouth and which extend inferiorly from the superior margin to an inferior margin of the body, in a position which leaves the first person's scalp uncovered, while also disposing a right wall of the right lateral margin which a) extends laterally outward to the right from the concave posterior surface, b) contains a right handgrip laterally spaced from the concave posterior surface, and c) has a posterior surface extending from the concave posterior surface at an angle to the concave posterior surface which is greater than a straight angle and disposing a left wall of the left lateral margin which d) extends laterally outward to the left from the concave posterior surface, e) contains a left handgrip laterally spaced from the concave posterior surface, and f) has a posterior surface extending from the concave posterior surface at an angle to the concave posterior surface which is greater than a straight angle and providing a seal on a posterior surface of the superior margin to seal continuously to the first person's forehead from a first location outward of one eye of the first person to a second location outward of the other eye of the first person to prevent intrusion of liquid between the mask body and the first person's forehead; and after the mask body has been so placed, using the first person's hands to hold the mask body in place by the first person's right hand grasping the right handgrip and by the first person's left hand grasping the left handgrip.

10. A method as set forth in claim 9 including causing the seal to resiliently compress into sealing contact with the first person's temples as the seal also seals against the first person's forehead.

11. A method as set forth in claim 10 in which the first person holds the mask body in place by grasping with fingers of his/her right hand curling around the right handgrip and with fingers of his/her left hand curling around the left handgrip.

12. A method as set forth in claim 11 in which the right handgrip is defined in part by a right through-slot in the right wall through which fingers of a person's right hand can extend, the left handgrip is defined in part by a left through-slot in the left wall through which fingers of a person's left hand can extend, and in which the first person holds the mask body in place by passing fingers of his/her right hand through the right through-slot to grasp the right handgrip and by passing fingers of his/her left hand through the left through-slot to grasp the left handgrip.

13. A method as set forth in claim 10 in which causing the seal to resiliently compress into sealing contact with the first person's temples as the seal also seals against the first person's forehead comprises causing thickness of the seal to resiliently compress laterally into sealing contact with the first person's temples as the seal also seals against the first person's forehead.

14. A method as set forth in claim 9 in which using the first person's hands to hold the mask body in place by the first person's right hand grasping the right handgrip and by the first person's left hand grasping the left handgrip comprises grasping the right handgrip at a location below the eyes of the first person and grasping the left handgrip at a location below the eyes of the first person.

15. A method as set forth in claim 9 further comprising applying a liquid to the first person's scalp.

* * * * *